US006474297B1

(12) United States Patent
De

(10) Patent No.: US 6,474,297 B1
(45) Date of Patent: Nov. 5, 2002

(54) FUEL BREAKING/SAVING DEVICE FOR CARS DURING COASTING

(76) Inventor: Lai Ming De, 4 Fl., No. 346, Wan Pan Rd., Panchiao City, Taipei (TW)

( * ) Notice: Subject to any disclaimer, the term of this patent is extended or adjusted under 35 U.S.C. 154(b) by 0 days.

(21) Appl. No.: 09/867,415

(22) Filed: May 31, 2001

(51) Int. Cl.[7] ..... F02D 41/30; F02D 31/00

(52) U.S. Cl. ..... 123/325; 123/326; 701/104; 701/112

(58) Field of Search ..... 123/325, 326, 123/332, 481, 482, 198 D, 198 DB; 701/104, 110, 112

(56) References Cited

U.S. PATENT DOCUMENTS

| | | | | | |
|---|---|---|---|---|---|
| 3,690,305 | A | * | 9/1972 | Shimada et al. | 123/325 |
| 3,727,591 | A | * | 4/1973 | Suda | 123/493 |
| 3,817,229 | A | * | 6/1974 | Stumpp | 123/332 |
| 3,866,584 | A | * | 2/1975 | Bigalke et al. | 123/325 |
| 4,075,988 | A | * | 2/1978 | Kato | 123/325 |
| 4,243,002 | A | * | 1/1981 | Freyer et al. | 123/325 |
| 4,253,437 | A | * | 3/1981 | Haramoto | 123/325 |
| 4,619,230 | A | * | 10/1986 | Collonia | 123/198 DB |
| 5,839,409 | A | * | 11/1998 | Denz et al. | 123/326 |

FOREIGN PATENT DOCUMENTS

| | | | | |
|---|---|---|---|---|
| DE | 3230670 | * | 3/1984 | F02M/3/04 |
| DE | 3422879 | * | 1/1985 | F02D/41/06 |
| DE | 3428072 | * | 1/1986 | F02D/9/08 |
| JP | 69753 | * | 5/1980 | F02M/37/00 |

* cited by examiner

*Primary Examiner*—Tony M. Argenbright
*Assistant Examiner*—Hai Huynh
(74) *Attorney, Agent, or Firm*—Bacon & Thomas, PLLC

(57) ABSTRACT

Fuel breaking/saving device for cars during coasting, including an automatic sensing power supply, a relay powered and controlled by the automatic sensing power supply to activate a fuel injector, a manual switch connected with a battery and a microswitch for controlling on/off of power, a normally closed microswitch connected with the automatic sensing power supply and the manual switch and activated and controlled by a linkage and a linkage connected with a throttle shaft and activated and controlled by an accelerator pedal. After receiving a message, the automatic sensing power supply compares the message with the standard value and judges whether the message reaches the standard value and then the automatic sensing power supply at proper time supplies power to the relay to make the relay decide whether the fuel injector should inject the fuel or break/save the fuel.

1 Claim, 4 Drawing Sheets

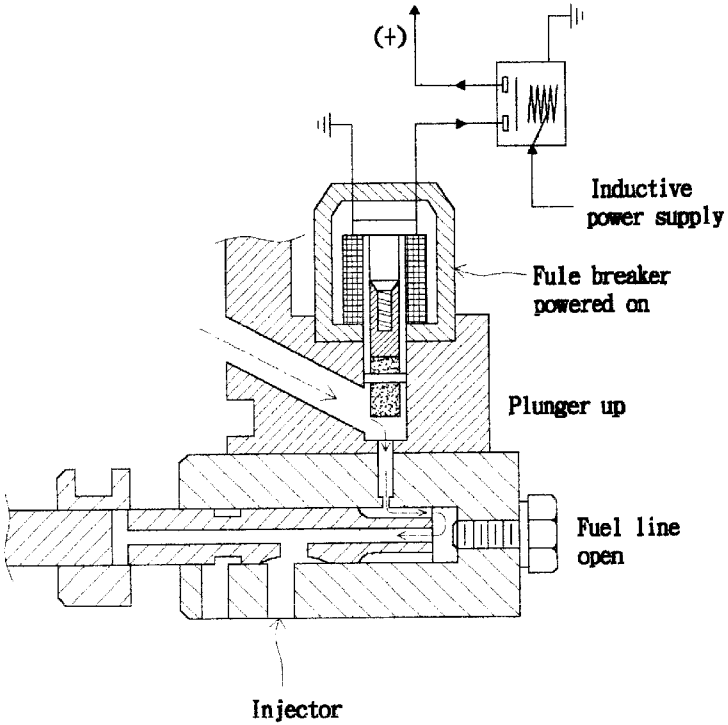
Fig 4-B
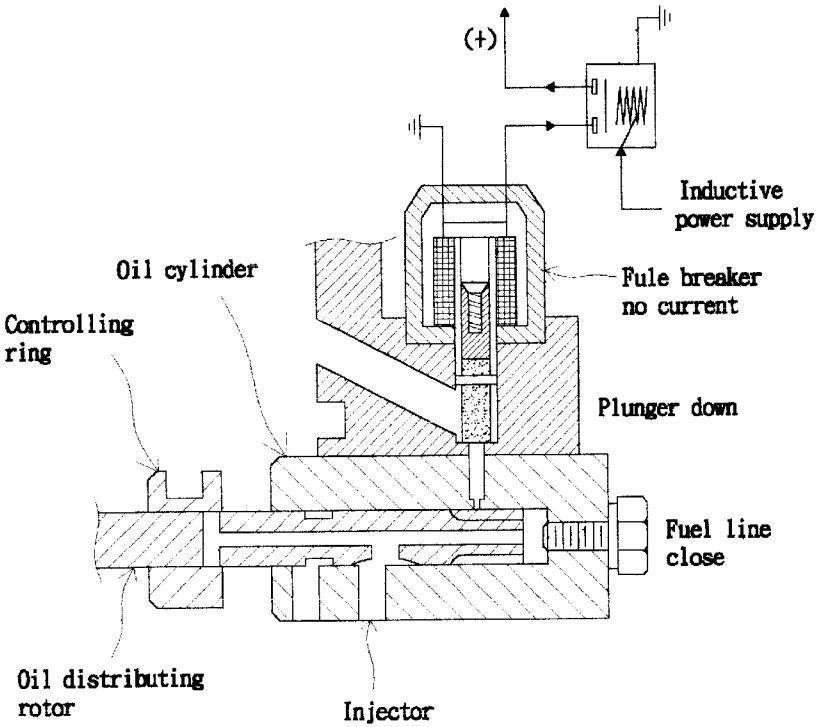
Fig 4-A

FUEL BREAKING/SAVING DEVICE FOR CARS DURING COASTING

BACKGROUND OF THE INVENTION

The present invention is related to a fuel breaking/saving device for cars during coasting. After a manual switch is turned on, during coasting of a car, the fuel breaking/saving device is able to controllably break the fuel or supply the fuel so as to save fuel.

Electric cars have been developed for reducing air pollution caused by gasoline-consuming cars and eliminating the problem of energy crisis. However, the electric cars have encountered problems of too heavy battery and poor ability in continuous running. Therefore, on the other hand, it is still necessary to study the subject of fuel-saving with respect to gasoline-consuming cars.

SUMMARY OF THE INVENTION

It is therefore a primary object of the present invention to provide a fuel breaking/saving device for cars during coasting. The fuel breaking/saving device includes an automatic sensing power supply able to controllably break the fuel or supply the fuel. The automatic sensing power supply can previously set a standard value of R.P.M. for idle speed of the engine and coasting of the car. The automatic sensing power supply senses and compares the actual rotational speed of the engine with the standard value to decide whether the fuel should be broken or supplied.

The present invention can be best understood through the following description and accompanying drawings wherein:

BRIEF DESCRIPTION OF THE DRAWINGS

FIG. 4 shows the operation of a part of the embodiment of the present invention according to FIG. 3.

DETAILED DESCRIPTION OF THE PREFERRED EMBODIMENTS

Figure 1:
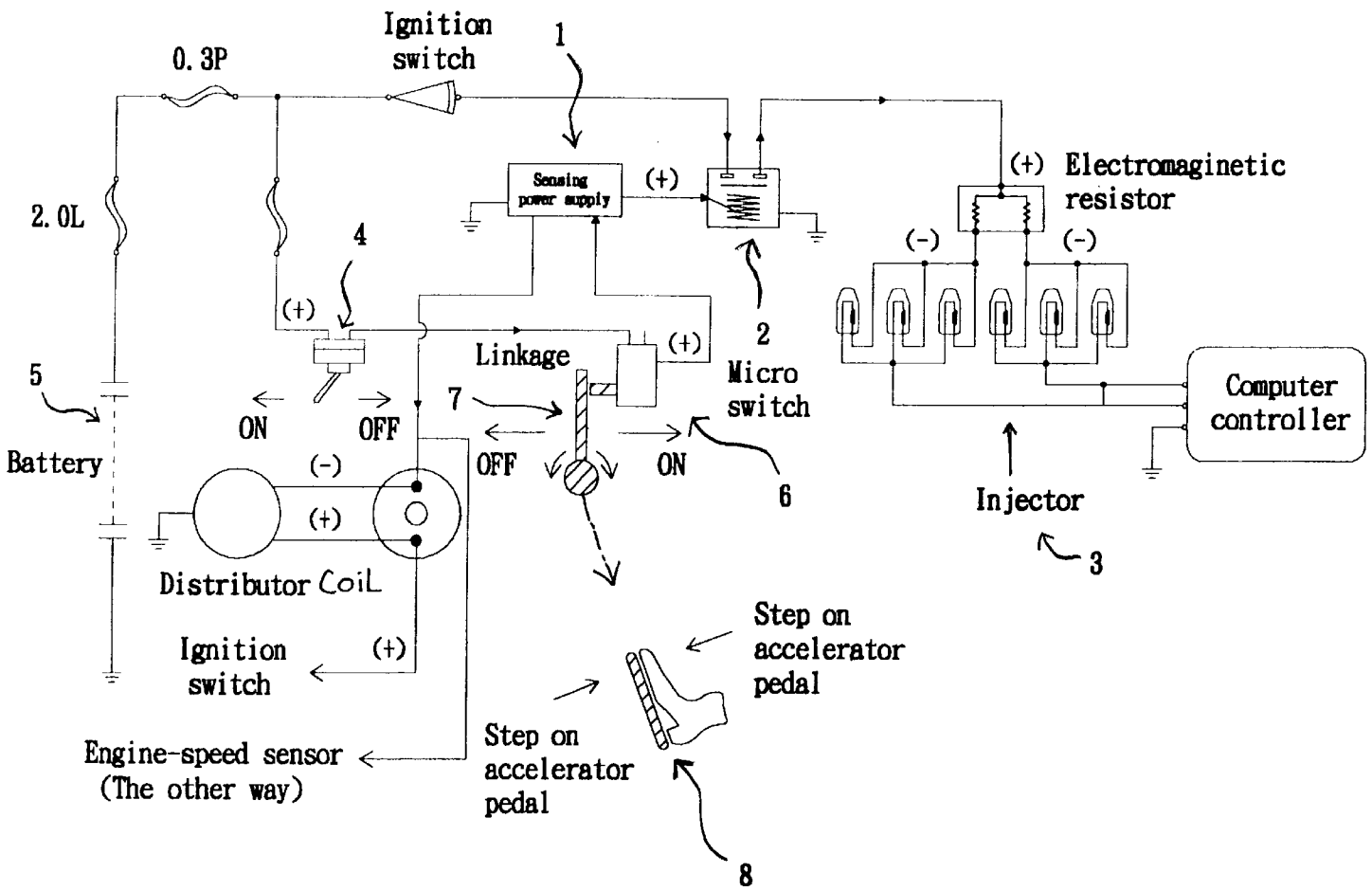
FIG. 1 shows the circuit structure of the present invention.

Please refer to FIG. 1 which shows the circuit structure of the present invention. The present invention cooperates with the electromagnetic resistor, computer controller, etc. of the existent car injection engine. The present invention includes:

an automatic sensing power supply 1 having comparison function, the automatic sensing power supply 1 being able to previously set a standard value of R.P.M. (which in this embodiment is set 1000 R.P.M.), after receiving a message, the automatic sensing power supply 1 comparing the message with the standard value and judging whether the message reaches the standard value, then the automatic sensing power supply 1 at proper time supplying power to a relay 2 to make the relay 2 decide whether the fuel injector 3 should inject the fuel, the automatic sensing power supply 1 being via wires connected to the ignition switch through the distributor to serve as an alternative engine rotational speed sensor;

a relay 2 powered and controlled by the automatic sensing power supply 1 to activate the fuel injector 3, when powered, the coil of the relay 2 is magnetically induced to cut off the power for the ignition switch and make the fuel injector 3 stop injecting fuel, after the power of the automatic sensing power supply 1 is cut off, the coil is demagnetized and the relay 2 again supplying power and the fuel injector 3 injecting fuel;

a manual switch 4 connected with the battery 5 and the microswitch 6 for controlling on/off of power;

a normally closed microswitch 6 connected with the automatic sensing power supply 1 and the manual switch 4 and activated and controlled by the linkage 7; and a linkage 7 connected with the throttle shaft and activated and controlled by the accelerator pedal 8, by means of stepping on or releasing the accelerator pedal 8, the linkage 7 separating from or pressing the microswitch 6.

The automatic sensing power supply 1 is practically used as follows:

Under the condition that the car is cold and just ignited and the idle speed is over the standard value (1000 R.P.M.), the manual switch 4 is off. At this time, the fuel-saving device is also turned off and the idle speed is normal. When the engine temperature reaches the normal range and the idle speed is under the standard value (1000 R.P.M), the manual switch 4 is on. At this time, the fuel-saving device is turned on. (The idle speed is about 800 R.P.M.) at normal engine temperature.)

Then, during deceleration and coasting of the car, the accelerator pedal 9 is released and the linkage 8 presses the microswitch 6 in an on state. In the case that the rotational speed of the engine is higher than the standard value of 1000 R.P.M., the automatic sensing power supply 1 will supply power to the relay 2 to turn off the relay 2. At the same time, the fuel injector 3 stops injecting the fuel and the car continuously coasts. However, when the speed of coasting car is gradually slowed down and the rotational speed of the engine is lower than the standard value of 1000 R.P.M., the automatic sensing power supply 1 will not further supply power to the relay 2 and the relay 2 is turned on. At this time, the fuel injector 3 again injects fuel.

Furthermore, when the car coasts, the user can at any time step on the accelerator pedal 8 to make the linkage 7 separate from the microswitch 6. At this time, the microswitch 6 is in off state and the automatic sensing power supply 1 is also in off state, while the relay 2 is demagnetized and in on state. Accordingly, the fuel injector 3 is in on state and the engine normal operates.

According to the above arrangement, in coasting state, when the rotational speed of the engine is within 1000~4000 R.P.M. or above, by means of releasing the accelerator pedal 8 or previously stepping on the brake pedal to make the rotational speed of the engine turns from high speed to low speed. Then, the fuel-saving design of the present invention will break the fuel and thus save the fuel and decrease pollution of air.

Figure 2:
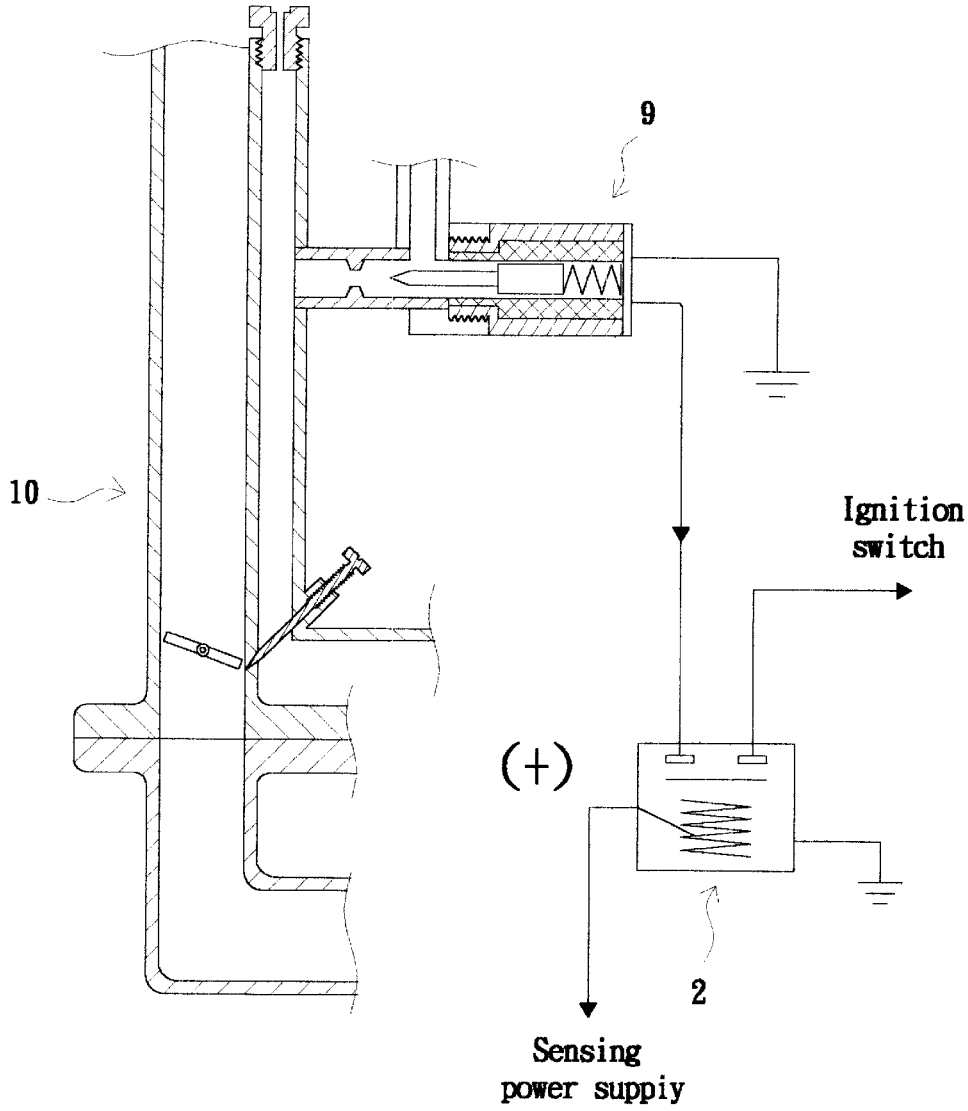
FIG. 2 shows the application of the present invention.

In addition, the fuel-saving device can be co-used with a plunger-type electromagnetic valve 9 as shown in FIG. 2 for controlling the fuel passage of the carburetor 10.

In fact, when driving in a downward area at peak time or in a district with many traffic signs, a driver will frequently accelerate and decelerate the car and the rotational speed of the engine is often within 1000~2000 R.P.M. Under such rotational speed, the pollution caused by the exhausted gas is most serious and the power consumption is greatest. By means of the fuel breaking/saving device of the present invention, the air pollution is minimized and the waste of power can be avoided.

Figure 3:
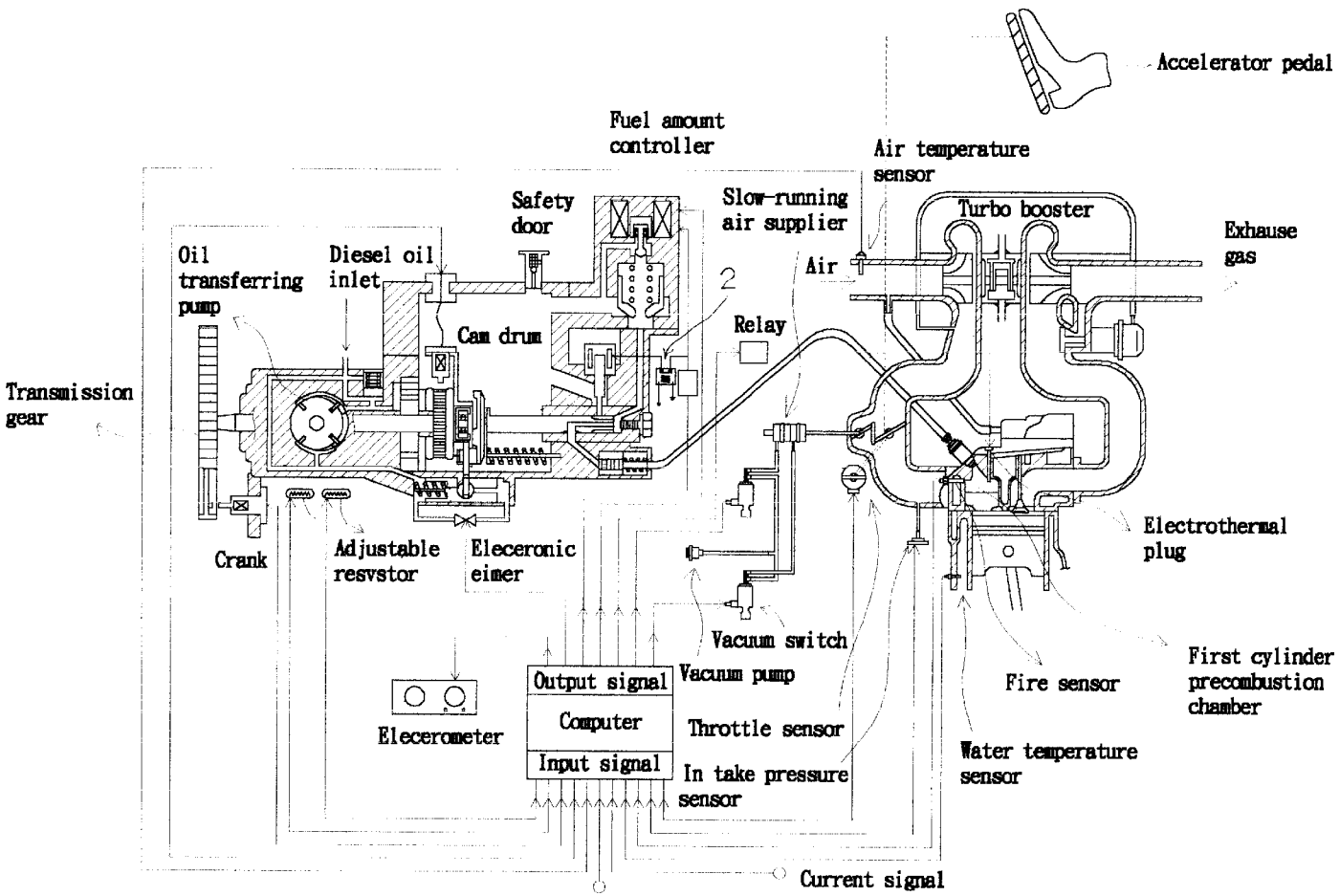
FIG. 3 shows another embodiment of the present invention.

In addition, the present invention is also applicable to computer fuel injector of Diesel engine as shown in FIG. 3.

The automatic sensing power supply 1 and the relay 2 are together disposed at a section of the fuel injector for controlling the fuel-breaker. Therefore, the automatic sensing power supply 1 can automatically detect R.P.M. of the engine of a car to turn on the relay 2. At this time, the automatic sensing power supply 1 is powered off and the relay 2 is in on state to again supply power and the fuel injector 3 injects fuel as shown in FIG. 4. Accordingly, an optimal time of fuel injection and fuel breaking/saving is determined so as to best save the fuel.

The above embodiments are only used to illustrate the present invention, not intended to limit the scope thereof. Many modifications of the above embodiments can be made without departing from the spirit of the present invention.

What is claimed is:

1. Fuel breaking/saving device for cars during coasting, comprising:

an automatic sensing power supply having comparison function and able to sense a preset standard value of R.P.M of an engine;

a relay powered and controlled by the automatic sensing power supply to activate a fuel injector;

a manual switch connected with a battery and a microswitch for controlling on/off of power;

a normally closed microswitch connected with the automatic sensing power supply and the manual switch and activated and controlled by a linkage; and a linkage connected with a throttle shaft and activated and controlled by an accelerator pedal, whereby after receiving a message, the automatic sensing power supply compares the message with the standard value and judges whether the message reaches the standard value and then the automatic sensing power supply at proper time supplies power to the relay to make the relay decide whether the fuel injector should inject the fuel or break/save the fuel.

* * * * *